US005382474A

United States Patent [19]

Adhya et al.

[11] Patent Number: 5,382,474

[45] Date of Patent: Jan. 17, 1995

[54] METHOD FOR PRODUCING POLYETHYLENE TEREPHTHALATE FIBERS WITH REDUCED FLAMMABILITY

[75] Inventors: Atish Adhya; Thomas F. Corbin; Robert L. Lilly, all of Asheville, N.C.

[73] Assignee: BASF Corporation, Parsippany, N.J.

[21] Appl. No.: 950,864

[22] Filed: Sep. 24, 1992

[51] Int. Cl.[6] ..... D02G 3/00

[52] U.S. Cl. ..... 428/364; 528/272; 528/277; 528/280; 528/281; 528/283; 528/285; 528/287; 528/308; 528/308.6; 528/502; 528/503; 524/780; 524/783; 524/785; 264/176.1

[58] Field of Search ..... 528/272, 277, 280, 281, 528/283, 285, 287, 308, 308.6, 502, 503; 524/780, 783, 785; 525/437, 444; 264/176.1; 428/364

[56] References Cited

U.S. PATENT DOCUMENTS

| | | | |
|---|---|---|---|
| 3,962,189 | 6/1976 | Russin et al. | 528/277 |
| 4,010,145 | 3/1977 | Russin et al. | 528/280 |
| 4,499,262 | 2/1985 | Fagerburg et al. | 528/279 |
| 4,501,878 | 2/1985 | Adams | 528/286 |
| 4,806,414 | 2/1989 | Brouwer | 428/260 |

*Primary Examiner*—Samuel A. Acquah

[57] ABSTRACT

Disclosed is a process for producing polyethylene terephthalate fibers with reduced flammability which comprises the following steps:

(a) condensating terephthalic acid and ethylene glycol in a mole ratio of from 1:1.1–1.5 at a temperature of from 180°to 240° C. in the presence of a catalyst;

(b) adding a polyalkylene glycol phosphate ester;

(c) polycondensating at a temperature of from 265°–280° C. under a pressure decreasing from 760 torr to less than 2 torr to form the polyethylene terepthalate; and (d) melt spinning fibers.

8 Claims, No Drawings

METHOD FOR PRODUCING POLYETHYLENE TEREPHTHALATE FIBERS WITH REDUCED FLAMMABILITY

FIELD OF THE INVENTION

The present invention is directed to a method for producing polyethylene terephthalate fibers with reduced flammability for the manufacture of textile articles, more specifically it is directed to the addition of a polyalkylene glycol phosphate ester to the polycondensation reaction for the manufacture of polyethylene terephthalate.

BACKGROUND OF THE INVENTION

The main approaches to reduce the flammability of thermoplastic polyesters are melt additives, topical finish treatments, and copolymerization with flame resistant monomers. Melt additives generally include halogenated organic compounds with high levels of bromine or chlorine. A second component when halogenated compounds are employed is antimony trioxide ($Sb_2O_3$). Other popular elements found in melt additives are phosphorus, molybdenum and nitrogen. Finish treatments generally require high add-on levels, and many of these lack the durability to cleaning procedures required for polyester fabrics such as mattress ticking, apparel, upholstery and drapery.

Phosphorus compounds are widely used to reduce the flammability of thermoplastic polymers. For example U.S. Pat. Nos. 3,987,008; 4,203,888; 4,517,355; and 4,940,772 disclose a broad variety of organic phosphor compounds in thermoplastic polyesters.

U.S. Pat. No. 3,987,008 discloses a polyphosphonate with arylene and haloarylene groups. U.S. Pat. No. 4,203,888 discloses an aryl diphosphate.

One disadvantage of these phosphorus compounds is that they are inert additives which build a separate phase in the thermoplastic polyesters with negative influence of the fiber properties like dyeability.

U.S. Pat. No. 4,517,355 describes a linear polyester, which contains a phosphinic acid derivative bonded in the macromolecule.

U.S. Pat. No. 4,940,772 describes a process for producing a flame resistant polyester by copolymerizing a polyester with an unsaturated compound and reacting this copolyester with a specific phosphorus compound.

An object of the present invention was to provide polyethylene terephthalate with reduced flammability and simultaneous excellent physical fiber properties.

Another object was to improve deep dyeability of polyethylene terepthalate fibers.

Another object was to provide a method for producing polyethylene terephthalate fibers with reduced flammability.

Still another object was to provide a masterbatch of polyethylene terephthalate with reduced flammability for the production of polyethylene terephthalate fibers by melt mixing and melt spinning.

SUMMARY OF THE INVENTION

The objects of the present invention could be achieved by a process for producing a polyethylene terephthalate fiber comprising the steps of:

(a) condensating at terephthalic acid and ethylene glycol in a molar ratio of from 1:1.1–1.5 at a temperature of from 180° to 240° C. in the presence of a catalyst;

(b) adding a polyalkylene glycol phosphate ester; and (c) polycondensating at a temperature of from 265°–300° C. under a pressure decreasing from 760 torr to less than 2 torr to form the polyethylene terephthalate; and (d) melt spinning fibers.

DETAILED DESCRIPTION OF THE INVENTION

The preparation of aromatic thermoplastic polyester is well known in the art and described for example in U.S. Pat. Nos. 4,517,355 and 4,981,945.

In step (a) terephthalic acid and ethylene glycol is condensated in a molar ratio of from about 1:1.1–1.5 at a temperature beginning from about 180° C. to a temperature of about 260° C. for a time period of up to about 2 to 3 hours in the presence of a catalyst, such as metal oxides or organic or inorganic metal salts, like antimony trioxide, germanium dioxide, manganese acetate, cobalt acetate and zinc acetate.

The catalyst content is from about 50 to 400 ppm based on the respective metal.

In a preferred embodiment of this invention this first step (a) is conducted using lower alkyl ester of terephthalic acid instead of terephthalic acid. Preferred is dimethyl terephthalate, whereby the formed methanol is distilled off the condensation reaction during the reaction time of from about 2 to about 3 hours.

At this point of the reaction the polyalkylene glycol phosphate ester is added as step (b).

The polyalkylene glycol phosphate ester of the present invention have the general formula:

$$[HO(CH_2-CH_2O)_n(CH_2-\overset{\overset{\displaystyle CH_3}{|}}{C}HO)_m]_3P{=}O$$

wherein n is a number of from 1 to 10 m is a number of from 0 to 3

R is H or $C_1$-to-$C_{18}$-alkyl radical.

Suitable polyalkylene glycol phosphate esters are for example tris (triethylene glycol) phosphate, tris (diethylene glycol) phosphate, and mixed tris (alkylene glycol) phosphates.

Preferred is tris (triethylene glycol) phosphate (TEGPa).

The phosphate ester is added in an amount of from about 0.4 to about 5.0% by weight, preferably from about 0.8 to about 1.6% by weight, based on the total weight of polyethylene terepthalate.

The condensation conditions are changed in step (c) to a temperature of from about 265 up to about 300° C., preferably 265 to 280° C with a pressure decreasing from 760 torr to less than 2 torr, preferably less than 1 torr, over a time period of from about 2 to 3 hours. During this time polycondensation occurs with the formation of a phosphate ester modified polyethylenene terephthalate having an intrinsic viscosity (IV) of from about 0.5 to about 0.7, preferably 0.55 to about 0.65. The phosphate ester is involved in the polycondensation by the reaction with its hydroxy or ester groups and forms a copolycondensation product of polyethylene terephthalate.

The amount of phosphorus in the final product for the manufacture of fibers with reduced flammability is from about 50 to about 2000 ppm, preferably from about 500 to about 1000 ppm phosphorus.

In a preferred embodiment of the present invention first a masterbatch of phosphate ester containing polyethylene terephthalate is produced containing from about 2000 to about 5000 ppm phosphorus. This master batch is mixed with fiber grade polyethylene terephthalate before processing into fibers by an extruder with spinnerette equipment.

In step (d) polyethylene terephthalate fibers are melt spun directly from the polymer melt of step (c) or from polyethylene terephthalate chips or granules, extruded from the polymer melt of step (c) or from the above-mentioned master batch, which is mixed with fiber grade polyethylene terephthalate.

The technique of fiber melt spinning is well known in the art, whereby the polyethylene terephthalate is fed into an extruder, in case of chips or granules melted and directed via Dowtherm heated polymer distribution lines to the spinning head. The polymer melt was then metered by a high efficiency gear pump to spin pack assembly and extruded through a spinnerette with a number of capillaries. The extruded filaments solidified, in a cross flow of chilled air. A finish based of lubrication oil and antistatic agents is then applied to the filament bundle for a proper processing performance. In the preferred technique, the filament bundle was drawn, textured and wound-up to form bulk continuous filament (BCF). The one-step technique of BCF manufacture is known in the trade as spin-draw-texturing (SDT). Two step technique which involves spinning and a subsequent texturing is also suitable for the manufacturing BCF of this invention.

The fibers show reduced flammability according to the vertical test method described in NFPA 701.

Other additives might be added to the fiber composition in effective amounts. Suitable additives are other flame retardants, UV-light stabilizers, antioxidants, pigments, dyes, antistatic agents, stain resistants, antimicrobial agents, nucleating agents and the like.

EXAMPLE

Synthesis of a master batch of modified polyethylene terephthalate

A mixture of dimethyl terephthalate (500 g), ethylene glycol (325 g), manganese acetate (0.1415 g) and antimony oxide (0.185 g) was heated while stirred under nitrogen. The temperature was raised from room temperature to 220° C. over a period of 2 hours. During the temperature rise, 160–170 ml of methanol is collected. After the methanol is removed the molten oligomer is cooled to 200° C. Tris (triethylene glycol) phosphate (25 g) (Emery 6696-A from Quantum Chemical Corporation, Emery Div.) was added to the molten oligomer and stirred for 5 min. The mixture was poured into the autoclave glass vessel and heated under decreasing pressure. The temperature was raised from 200° C. to 295° C. Excess ethylene glycol and some oligomers were removed, under vacuum, from the polymerizing mixture. The change in viscosity was visually observed and the polymer was extruded when the IV (intrinsic viscosity) of the polymer reached approximately 0.6. The analytical results show the phosphorous concentration was 0.48%.

EXAMPLE 1 (Control)

Fiber Spinning Procedure 21.2 lbs Polyethylene terephthalate (Polyester chips Ultradur® T-735, BASF AG, Ludwigshafen, Germany) were spun into fibers in a conventional manner with a standard melt spinning equipment at a speed of 1,600 m/min and then drawn at a rate of 647 m/min to give an elongation of 30% and tenacity of 4.5 g/denier.

EXAMPLE 2

Fiber Spinning Procedure 21.2 lbs Polyethylene terephthalate (Polyester chips Ultradur® T-735, BASF AG, Ludwigshafen, Germany) were tumble blended with the 4.2 lb master batch described above. The mixture was spun into fibers in a conventional manner with a standard melt spinning equipment at a speed of 1,600 m/min and then drawn at a rate of 647 m/min to give an elongation of 30% and tenacity of 4.5 g/denier.

Vertical Burn Test Procedure

Three pirns (three ends) of the drawn yarns, from Example 1 (control) and Example 2, were knit into a sock by a standard knitting machine. The socks were scoured, heat set at 375° C. and dried in a vacuum oven at 108° C. for three days. The phosphorous concentration in the yarn was 202 ppm. The socks were cut into 8"in length and two pieces from each Example were placed one on top of the other. The socks were mounted on a standard frame mentioned in the NFPA 701 test method. Vertical test method described in NFPA 701, Fire Tests for Flame-Resistant Textiles and Films, 1989, National Fire Protection Association Batterymarch Park, Quincy, Mass. 02269, was used to compare the flammability of Example 2 to that of the control. The average, burn time and the properties of Example 1 and Example 2 yarns are listed in the following table:

TABLE

| | EXAMPLE 1 Burn Time (s) | EXAMPLE 2 Burn Time (s) |
|---|---|---|
| | 53 | 2 |
| | 77 | 1 |
| | 48 | 0 |
| | 76 | 1 |
| | 30 | 0 |
| | 73 | 1 |
| | 63 | 2 |
| | 106 | 1 |
| | 71 | 1 |
| AVG | 66.0 | 1.0 |
| DEN | 151.0 | 150.0 |
| TEN | 4.8 | 4.5 |
| ELN | 27.0 | 30.0 |
| BWS | 8.3 | 8.2 |
| CV | 1.3 | 1.1 |
| IV | 0.6 | 0.57 |

AVG = Average
DEN = Denier
TEN = Tenacity
ELN = Elongation
BWS = Boiling water shrinkage
CV = Evenness
IV = Intrinsic Viscosity (1% solution in phenol/tetrachloroethane (60:40) at 25° C.)

The average burn time of the control (Example 1) was 66 seconds whereas the average burn time of the TEGPa containing sample (Example 2) was 1 sec. The physical properties of the TEGPa and the control samples are similar considering the fact the TEGPa samples were spun under the same conditions as the control.

We claim:

1. A process for producing polyethylene terephthalate fibers with reduced flammability, comprising the steps of:

(a) condensating terephthalic acid and ethylene glycol in a mole ratio of from 1:1.1–1.5 at a temperature of from 180° to 240° C. in the presence of a catalyst;

(b) adding a polyalkylene glycol phosphate ester in an amount that the polyethylene terephthalate contains from about 500 to about 2000 ppm phosphorous;

(c) polycondensating at a temperature of from 265°–280° C. under a pressure decreasing from 760 torr to less than 2 torr to form the polyethylene terephthalate; and (d) melt spinning fibers.

2. The process according to claim 1, wherein the terephthalic acid is replaced by dimethyl terephthalate, thereby forming and distilling off methanol in step (a).

3. The process according to claim 1, wherein said polyalkylene glycol phosphate ester is selected from the group consisting of tris (triethylene glycol) phosphate, tris (diethylene glycol) phosphate and mixed tris (alkylene glycol) phosphates.

4. The process according to claim 1, wherein said catalyst is selected from the group consisting of metal oxides, organic metal salts, and inorganic metal salts.

5. The process according to claim 4, wherein said catalyst is selected from the group consisting of antimon trioxide, germanium dioxide, manganese acetate, cobalt acetate, zinc acetate and mixtures thereof.

6. The process according to claim 1, wherein the catalyst content is from about 50 to about 500 ppm, based on the respective metal.

7. The process according to claim 1, wherein the polyethylene terephthalate of step (c) is extruded into particles before the fiber melt spinning.

8. A polyethylene terephthalate fiber, obtained by the process according to claim 1.

* * * * *